US008044891B2

(12) United States Patent
Peng

(10) Patent No.: US 8,044,891 B2
(45) Date of Patent: Oct. 25, 2011

(54) SYSTEMS AND METHODS FOR PROVIDING THRESHOLD VOLTAGE COMPENSATION OF PIXELS

(75) Inventor: Du-Zen Peng, Chubei (TW)

(73) Assignee: Chimei Innolux Corporation, Miao-Li County (TW)

( * ) Notice: Subject to any disclaimer, the term of this patent is extended or adjusted under 35 U.S.C. 154(b) by 961 days.

(21) Appl. No.: 11/197,972

(22) Filed: Aug. 5, 2005

(65) Prior Publication Data

US 2007/0030217 A1 Feb. 8, 2007

(51) Int. Cl.
*G09G 3/30* (2006.01)

(52) U.S. Cl. ..... 345/76; 345/78

(58) Field of Classification Search ..... 345/76–81, 345/87–104, 211
See application file for complete search history.

(56) References Cited

U.S. PATENT DOCUMENTS 6,392,629 B1 * 5/2002 Murakami et al. ..... 345/98
7,167,169 B2 * 1/2007 Libsch et al. ..... 345/211
2004/0026723 A1 2/2004 Miyazawa

FOREIGN PATENT DOCUMENTS

CN 1482586 3/2004

OTHER PUBLICATIONS

Komiya, N. "Comparison of Vth compensation ability among voltage programming circuits for AMOLED panels" IDW, 2003, pp. 275-278, AMD4/OEL5-3.*
CN Office Action mailed Nov. 16, 2007.

* cited by examiner

*Primary Examiner* — Yong H Sim
(74) *Attorney, Agent, or Firm* — Thomas|Kayden

(57) ABSTRACT

Systems and methods for providing threshold voltage compensation of pixels are provided. A representative system incorporates first switching element and a voltage compensation driver. The first switching element is operative to transfer a data signal. The voltage compensation driver is operative to generate a compensation voltage according to a reference signal and output a driving current according to the data signal and the compensation voltage.

16 Claims, 5 Drawing Sheets

600

700

SYSTEMS AND METHODS FOR PROVIDING THRESHOLD VOLTAGE COMPENSATION OF PIXELS

BACKGROUND

The invention relates to panel displays and, more particularly, to pixel driving circuitry.

Active matrix organic light emitting diode (AMOLED) displays are currently the prevailing type of flat panel display. As compared with an active matrix liquid crystal display (AMLCD), an AMOLED display typically provides many advantages, such as higher contrast ratio, wider viewing angle, thinner profile, no backlight, lower power consumption and lower cost. Unlike an AMLCD display, which is driven by a voltage source, an AMOLED display requires a current source to drive an electroluminescent (EL) device. The brightness of the EL device is proportional to the current conducted thereby. Variations of the current level tend to impact display uniformity of an AMOLED display. Thus, the quality of a pixel driving circuit, which controls current output, can be critical to display quality.

FIG. 1 illustrates a conventional 2T1C (2 transistors and 1 capacitor) circuit 10 for a pixel in an AMOLED display. When a signal SCAN turns on transistor M1, data (shown as $V_{data}$) is loaded into the gate of P-type transistor M2 and is stored in the capacitor $C_{st}$. Thus, a constant current drives the EL device to emit light. Typically, in an AMOLED, a current source is implemented by a P-type thin film transistor (TFT) that is gated by a data voltage $V_{data}$. The source and drain of the P-type TFT are connected to $V_{dd}$ and to the anode of the electroluminescent (EL) device, respectively. The brightness of the EL device with respect to $V_{data}$ therefore has the following relationship:

$$\text{Brightness} \propto \text{current} \propto (V_{dd}-V_{data}-V_{th})^2.$$

SUMMARY

Systems and methods for providing threshold voltage compensation of pixels are provided. In this regard, some embodiments can potentially compensate for variation of threshold voltage. In some embodiments, this is accomplished using a driving current that is $V_{th}$ independent. Thus, the brightness of a pixel can be $V_{th}$ independent.

In this regard, an embodiment of a system for providing threshold voltage compensation of pixels comprises a pixel driving circuit. The pixel driving circuit comprises a first switching element that is operative to transfer a data signal. The pixel driving circuit also comprises a voltage compensation driver that is operative to generate a compensation voltage according to a reference signal and output a driving current according to the data signal and the compensation voltage.

Another embodiment of a system for providing threshold voltage compensation of pixels comprises a display panel. The display panel comprises a pixel array with scan lines, a gate driver, a source driver and a reference signal generator. The gate driver is operative to provide scan signals to the pixel array to assert or de-assert the scan lines. The source driver is operative to provide a data signal to the pixel array, and the reference signal generator is operative to provide a reference signal to the pixel array. Additionally, the pixel array incorporates a pixel driving circuit. The pixel driving circuit comprises a first switching element that is operative to transfer the data signal. The pixel driving circuit also comprises a voltage compensation driver that is operative to generate a compensation voltage according to the reference signal and output a driving current according to the data signal and the compensation voltage.

An embodiment of a method for providing threshold voltage compensation of pixels comprises: loading a threshold compensation voltage of a first transistor into a first capacitor according to a reference signal; loading a data signal and the loaded threshold compensation voltage into a second capacitor; and coupling the loaded data signal and the loaded threshold compensation voltage to the first transistor to provide a threshold independent driving current to a display device.

DETAILED DESCRIPTION

Since variations of threshold voltage ($V_{th}$) of driving transistors in pixel driving circuits can lead to non-uniformity of display characteristics of displays, such as AMOLED displays, $V_{th}$ compensation can be important in improving the quality of such displays. In this regard, systems and methods for providing threshold voltage compensation of pixels are provided. In some embodiments, compensation for variation of threshold voltage is achieved using a driving current that is $V_{th}$ independent. Thus, the brightness of a pixel incorporated into such a display can be $V_{th}$ independent.

Figure 1:
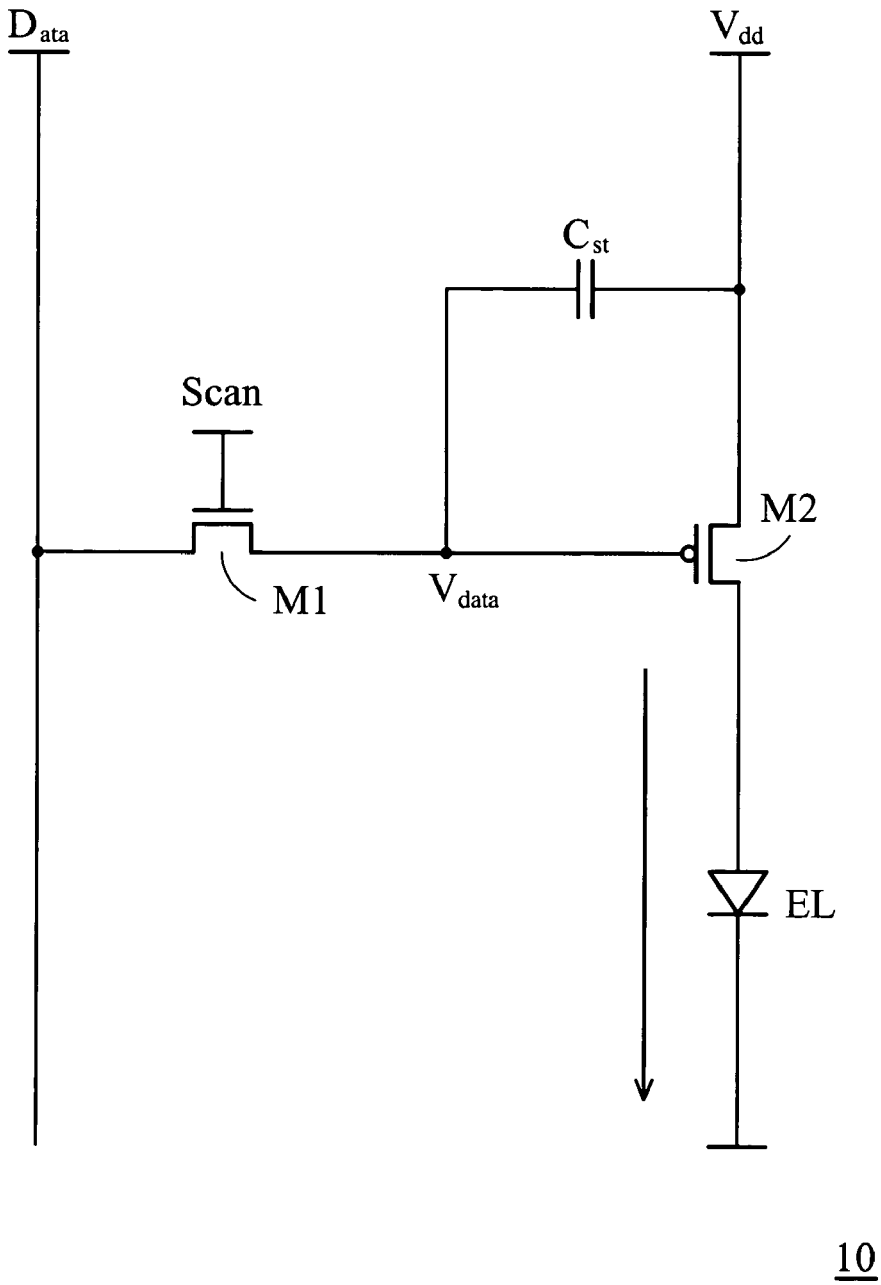
FIG. 1 ( RELATED ART )
FIG. 1 illustrates a conventional 2T1C circuit for a representative pixel in an AMOLED display.
Figure 2:
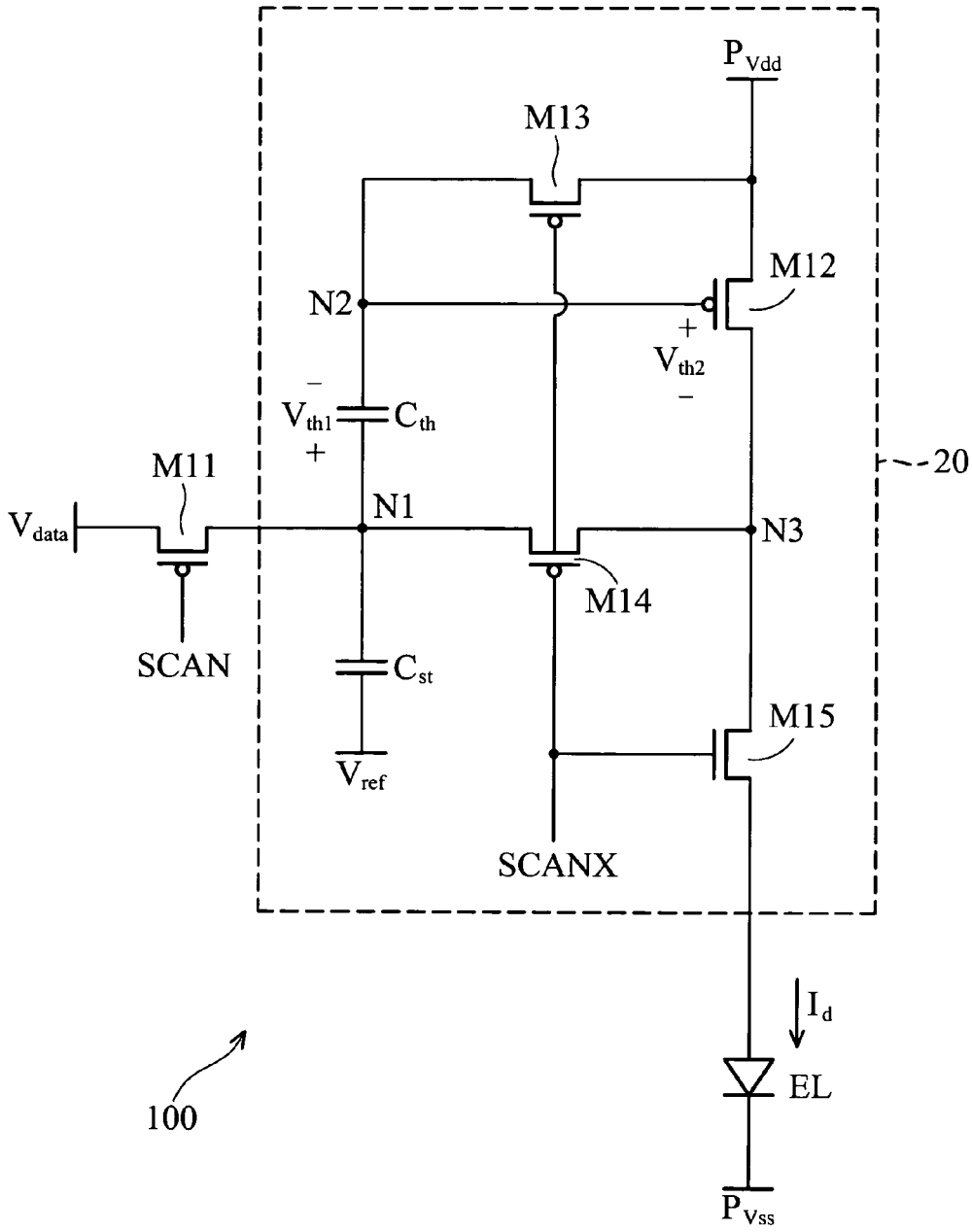
FIG. 2 shows an embodiment of a pixel driving circuit.

An embodiment of a system, in this case a pixel driving circuit, for providing threshold voltage compensation of pixels is depicted in FIG. 2. As shown in FIG. 2, the pixel driving circuit 100 comprises a first switching element M11 and a voltage compensation driver 20.

The first switching element M11 is coupled between a data signal $V_{data}$ and the node N1 and is controlled by the scan line SCAN. The first switching element M11 transfers the data signal $V_{data}$ to the first node N1 when the scan line SCAN is asserted. The voltage compensation driver 20 generates a compensation voltage according to a reference signal $V_{ref}$ and outputs a driving current $I_d$, such as to an electronic display device EL, according to the data signal $V_{data}$ and the compensation voltage.

The voltage compensation driver 20 is coupled between the first switching element M11 and the display device EL, and comprises a key transistor M12, three switching elements M13-M15, and two capacitors $C_{st}$ and $C_{th}$. The key transistor M12 is coupled between power voltage $P_{Vdd}$ and the drain terminal of the switching element M15. The key transistor also has a control terminal coupled to the node N2. The switching element M13 is coupled between the power voltage $P_{Vdd}$ and the node N2, and the capacitor $C_{th}$ is coupled between the nodes N1 and N2. The switching element M14 is coupled between the nodes N1 and N3, and the capacitor $C_{st}$ is coupled between the first node N1 and the reference signal $V_{ref}$. The switching element M15 is coupled between the display device EL and the node N3. Control terminals of the switching elements M13, M14 and M15 are coupled to the scan line SCANX. The display device EL is coupled between the switching element M15 and power voltage $P_{Vdd}$. The display device emits light according to a driving signal from the pixel driving circuit 100.

In this embodiment, the display device EL can be an electroluminescent device, and the key transistor M12 can be a thin film transistor (TFT). The switching elements M1 and M13-M15 can be active elements, such as thin film transistors (TFTs) or transmission gates, for example. Preferably, the switching elements M11, M13-M15 and the key transistor M12 are polysilicon thin film transistors, potentially providing higher current driving capability.

In this case, the switching elements M11, M13 and M14, and the key transistor M12 are P-type TFTs, and the switching element M15 is a N-type TFT. The scan line SCAN can be the $N^{th}$ scan line and the SCANX can be the $N-1^{th}$ scan line. The scan lines SCAN and SCANX may be asserted or de-asserted by a gate driver, such as driver 620 of FIG. 4, the data signal $V_{data}$ may be provided by a source driver, such as source driver 630 of FIG. 4, and the reference signal $V_{ref}$ may be provided by a reference signal generator, such as the reference signal generator 640 of FIG. 4.

Figure 3:
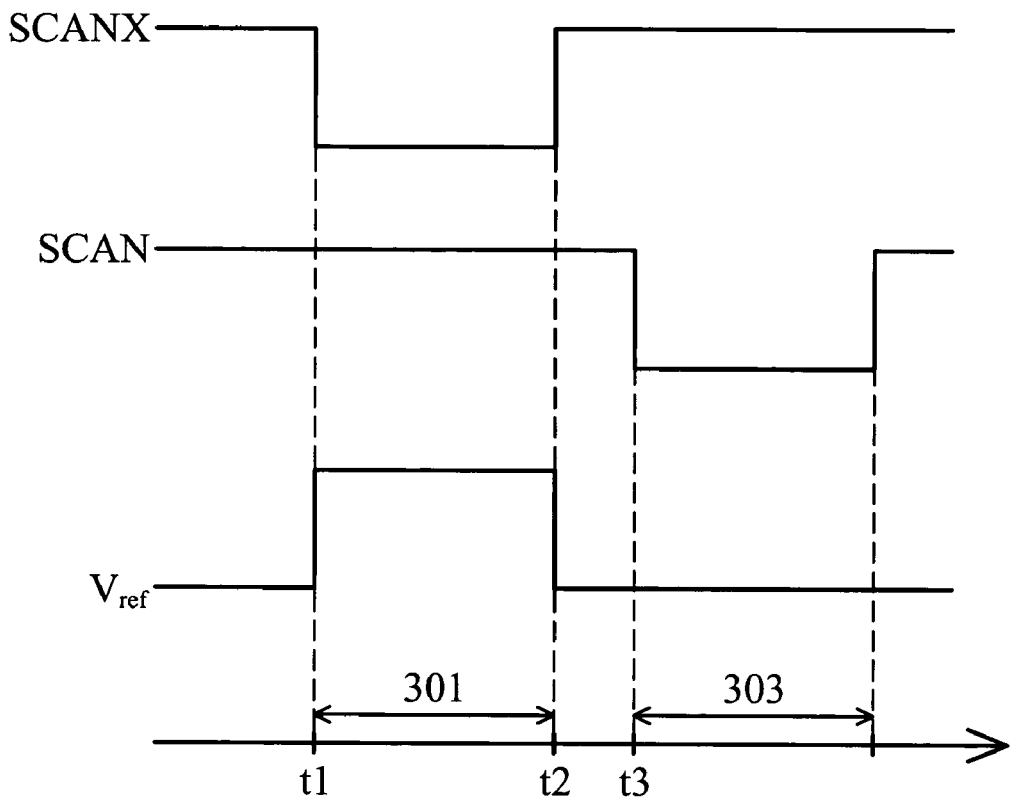
FIG. 3 is a timing chart of the pixel driving circuit of FIG. 2.

FIG. 3 is a timing chart of the embodiment of the pixel driving circuit of FIG. 2. In this embodiment, the scan lines SCAN and SCANX are asserted or de-asserted by a gate driver and the reference signal $V_{ref}$ is provided by a reference signal generator to function in the manner as described below.

At time interval 301, the scan line SCANX is asserted (pulled low), the scan line SCAN is de-asserted (pulled high), and the reference signal $V_{ref}$ goes high. For example, the reference signal $V_{ref}$ is pulled to the power voltage $P_{Vdd}$. The switching element M11 is turned off because the scan line SCAN is de-asserted. The switching elements M12-M14 are turned on and the switching element M15 is turned off because the scan line SCANX is asserted. Because the capacitor $C_{st}$ stores a data signal from a previous driving operation, a charge voltage exceeding the power voltage $P_{Vdd}$ is generated at the node N1 when the reference signal $V_{ref}$ goes high at time t1. Due to the charge voltage, a compensation voltage $V_{th1}$ is stored to the capacitor $C_{th}$, with voltage $|V_{th1}|$ being equal to a threshold voltage $V_{th2}$ of the key transistor M12.

In this case, when the scan line SCANX is de-asserted at time t2, the reference signal $V_{ref}$ goes low (is pulled to ground). In some examples, the reference signal $V_{ref}$ is not able to go low immediately after the scan line SCANX is de-asserted, but goes low before the scan line SCAN is asserted at time t3.

At time interval 303, the scan line SCAN is asserted (pulled low) and the scan line SCANX is de-asserted (pulled high), the switching elements M11 and M15 and the key transistor M12 are turned on and switching elements M13 and M14 are turned off. Because the switching element M11 is turned on and the switching elements M13 and M14 are turned off, the data signal $V_{data}$ is transferred to the node N1 and stored in the capacitor $C_{st}$ such that a voltage of $V_{data}$-$V_{th1}$ is generated at node N2.

The electrical current $I_d$ flows through the key transistor M12 with respect to the following relationship, wherein the source voltage $V_s$ of the transistor M12 is $P_{Vdd}$, the gate voltage $V_g$ of the transistor M12 is $V_{data}$-$V_{th1}$ and the threshold voltage of the transistor M12 is $V_{th2}$:

$$I_d \propto (V_{sg}-V_{th2})^2=(P_{Vdd}-V_{data}+V_{th1}-V_{th2})^2$$

$$\propto (P_{Vdd}-V_{data})^2.$$

Accordingly, the key transistor M12 can generate a driving current $I_d$ to drive the display device EL according to the data signal $V_{data}$ because the threshold voltage $V_{th2}$ of the key transistor M12 can be compensated by the compensation voltage $V_{th1}$ stored in the capacitor $C_{th}$. The driving current $I_d$ can drive the display device EL to emit brightness because the switching element M15 is turned on.

Because the threshold voltage $V_{th2}$ of the key transistor M12 in this embodiment can be compensated by the compensation voltage $V_{th1}$, the driving current $I_d$ is independent of the threshold voltage $V_{th2}$ of the key transistor M12. Thus, the brightness of each pixel of a display incorporating such a pixel driving circuit can be independent of the threshold voltage $V_{th2}$. As the brightness of such a pixel can be independent of the threshold variation, display uniformity can potentially be improved.

Figure 4:
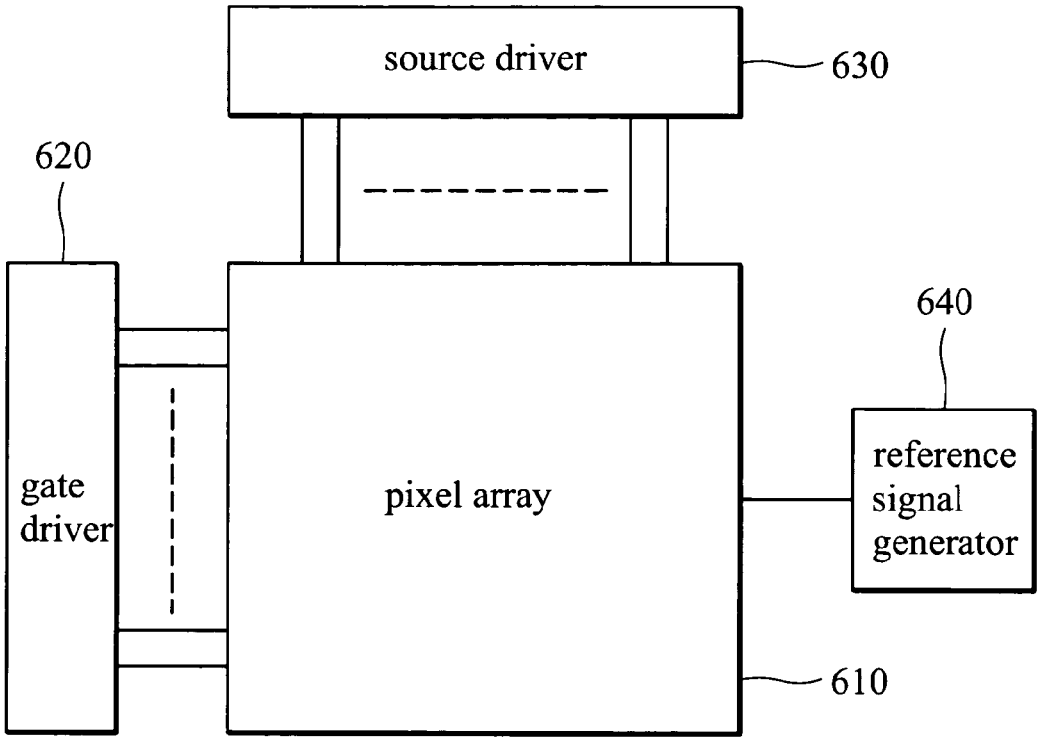
FIG. 4 is schematic diagram of an embodiment of a display panel.

FIG. 4 is a schematic diagram of another embodiment of a system, in this case a panel display, for providing threshold voltage compensation of pixels. As shown in FIG. 4, display panel 600 comprises a pixel array 610, a gate driver 620, a source driver 630, and a reference signal generator 640. The pixel array 610 comprises pixel driving circuits, such as the embodiment of the pixel driving circuit shown in FIG. 2, for example. The gate driver 620 provides scan signals to the pixel array such that scan lines are asserted or de-asserted. The source driver 630 provides the data signals to the pixel driving circuits in the pixel array 610. The reference signal generator 640 provides the reference signals to the pixel driving circuits in the pixel array 610, and can be integrated into the gate driver 620. Notably, the display panel 600 can be an organic light-emitting diode (OLED) display panel; however, various other technologies can be used in other embodiments.

Figure 5:
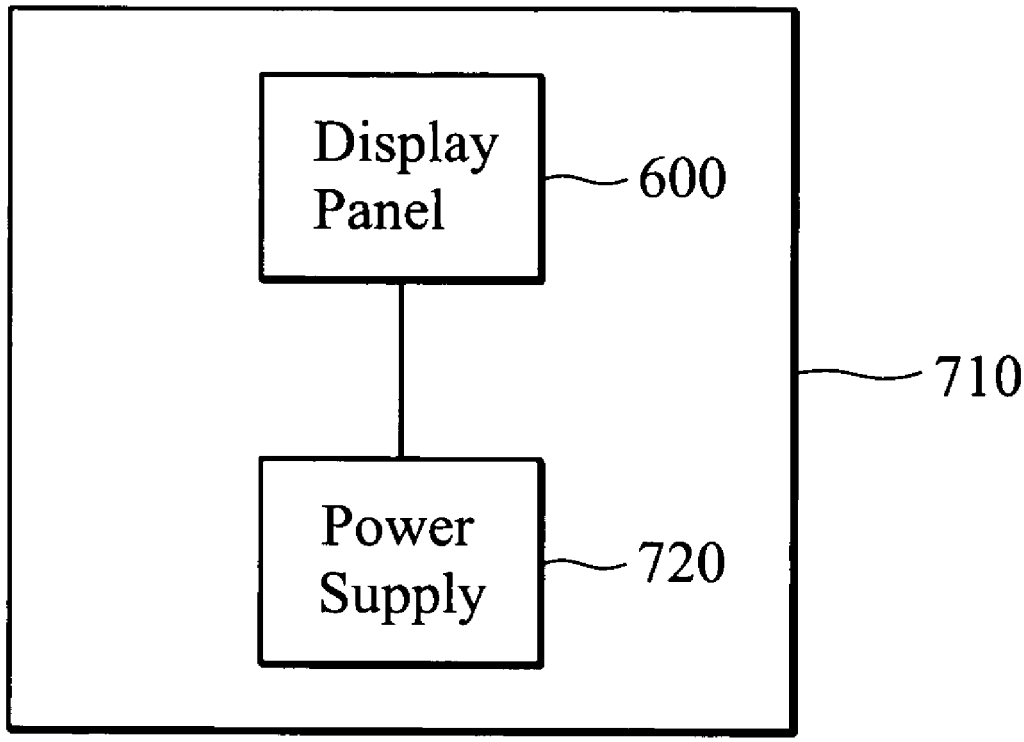
FIG. 5 is schematic diagram of an embodiment of an electronic device employing the display panel shown in FIG. 4.

FIG. 5 schematically shows an embodiment of yet another system, in this case an electronic device, for providing threshold voltage compensation of pixels. In particular, electronic device 700 employs the previously described display panel 600 of FIG. 4. The electronic device 700 may be a device such as a PDA, notebook computer, tablet computer, cellular phone, or a display monitor device, for example.

Generally, the electronic device 700 includes a housing 710, a display panel 600, and power supply 720, although it is to be understood that various other components can be included; however, such other components are not shown or described here for ease of illustration and description. In operation, the power supply 720 provides powers the display panel 600 so that the display panel 600 can display images.

While the invention has been described by way of example and in terms of representative embodiments, it is to be understood that the invention is not limited thereto. To the contrary, it is intended that the invention cover various modifications and arrangements as would be apparent to one skilled in the art.

What is claimed is:

1. A system for providing threshold voltage compensation of pixels comprising: a first switching element transferring a data signal; and a voltage compensation driver coupled between a power voltage and a display device, inducing a charging voltage on a first node according to a reference signal and generating a compensation voltage according to the charging voltage during a first period, and outputting a driving current according to the data signal and the compensation voltage to the display device during a second period following with the first period, wherein the charging voltage is higher than the power voltage, and the reference signal is pulled to the power voltage with in the first period and is pulled to ground within the second period, and wherein the power voltage is maintained during the first and the second periods, and the voltage compensation driver comprises a key transistor coupled between the power voltage and the display device, generating the driving current according to the data signal and the compensation voltage;

a first capacitor coupled between the reference signal and the first node; and a second capacitor coupled between the first node and the key transistor, storing the compensation voltage, and the voltage compensation driver and the first switching element are coupled to a first scan line and a second scan line respectively, and the first scan line is asserted during the first period and the second scan line is asserted ruing the second period later than the first period.

2. The system as claimed in claim 1, wherein the compensation voltage, having a voltage equal to a threshold voltage of the key transistor, is stored in the second capacitor responsive to the first scan line being asserted.

3. The system as claimed in claim 1, wherein the first switching element transfers the data signal responsive to the second scan line being asserted.

4. The system as claimed in claim 1, wherein the key transistor comprises a first terminal coupled to the power voltage, a control terminal coupled to the second capacitor, and a second terminal.

5. The system as claimed in claim 1, wherein the display device is an electroluminescent device.

6. The system as claimed in claim 1, wherein the display device comprises an organic light emitting device.

7. The system as claimed in claim 1, further comprising:

a source driver operative to provide the data signals; and a reference signal generator operative to provide the reference signal.

8. The system as claimed in claim 1, wherein the voltage compensation driver is coupled to a first scan line and further comprises means for storing the compensation voltage in response to the first scan line being asserted.

9. The system as claimed in claim 1, wherein the system is implemented as at least one of a PDA, a display monitor, a notebook computer, a tablet computer, or a cellular phone.

10. The system as claimed in claim 4, wherein the voltage compensation driver further comprises:

a second switching element coupled between the power voltage and a gate of the key transistor;

a third switching element coupled between the second terminal of the key transistor and the first node; and a fourth switching element coupled between the second terminal of the key transistor and the display device, wherein the second and third switching elements are turned on and the fourth switching element is turned off responsive to the first scan line being asserted.

11. The system as claimed in claim 4, wherein the key transistor and the first, the second, the third and the fourth switching elements are polysilicon thin film transistors.

12. A method for providing threshold voltage compensation of pixels, comprising:

inducing a charging voltage on a first node according to a reference signal during a first period;

loading a threshold compensation voltage of a first transistor into a first capacitor according to the charge voltage during the first period;

loading a first data signal and the loaded threshold compensation voltage into a second capacitor during a second period later than the first period; and coupling the loaded data signal and the loaded threshold compensation voltage to the first transistor to provide a threshold independent driving current to a display device during the second period, wherein the charge voltage is higher than a power voltage, and the reference signal is pulled to the power voltage within the first period and is pulled to ground within the second period;

wherein the first transistor is coupled between the power voltage and the display device, and the power voltage is maintained during the first and second periods, and the first capacitor is coupled between the reference signal and the first node, and the second capacitor is coupled between the first node and the first transistor, storing the compensation voltage.

13. The method as claimed in claim 12, wherein the charging voltage is induced on the first node according to a second data signal stored during a previous driving operation in the second capacitor and the reference signal.

14. The method as claimed in claim 12, wherein the display device is an electroluminescent device.

15. A system for providing threshold voltage compensation of pixels comprising:

a voltage compensation driver coupled between a power voltage and a display device, inducing a charging voltage on a first node according to a reference signal and generating a compensation voltage according to the charging voltage during a first period, and providing a driving current to the display device according to the compensation voltage during a second period later than the first period, and the charging voltage is higher than the power voltage, and the reference signal is pulled to the power voltage within the first period and is pulled to ground within the second period, wherein the power voltage is maintained during the first and the second periods, wherein the voltage compensation driver comprises:

a key transistor having a first terminal coupled to the power voltage and a second terminal coupled to the display device;

a first capacitor coupled between the first node and the reference signal; and a second capacitor coupled between the first node and a control terminal of the key transistor, storing the compensation voltage according to a first data signal stored during a previous driving operation in the first capacitor and the charging voltage higher than the power voltage, such that the key transistor generates and outputs the driving current according to the compensation voltage and a second data signal from a first switching element.

16. The system as claimed in claim 15, wherein the charging voltage higher than the power voltage is inducted by the first data signal stored during the previous driving operation in the first capacitor and the reference signal, such that the compensation voltage having a voltage equal to a threshold voltage of the key transistor is stored into the second capacitor.

* * * * *